US009319765B2

(12) United States Patent
Ravnkilde

(10) Patent No.: US 9,319,765 B2
(45) Date of Patent: Apr. 19, 2016

(54) MEMS MICROPHONE ASSEMBLY AND METHOD OF MANUFACTURING THE MEMS MICROPHONE ASSEMBLY

(75) Inventor: Jan Tue Ravnkilde, Hedehusene (DK)

(73) Assignee: Epcos AG, München (DE)

( * ) Notice: Subject to any disclaimer, the term of this patent is extended or adjusted under 35 U.S.C. 154(b) by 0 days.

(21) Appl. No.: 14/388,144

(22) PCT Filed: May 2, 2012

(86) PCT No.: PCT/EP2012/058031

§ 371 (c)(1),
(2), (4) Date: Nov. 3, 2014

(87) PCT Pub. No.: WO2013/164021

PCT Pub. Date: Nov. 7, 2013

(65) Prior Publication Data

US 2015/0054098 A1 Feb. 26, 2015

(51) Int. Cl.

| | |
|---|---|
| ***H04R 1/08*** | (2006.01) |
| ***H04R 19/00*** | (2006.01) |
| *H04R 31/00* | (2006.01) |

(52) U.S. Cl.

CPC ..... *H04R 1/08* (2013.01); *H04R 19/005* (2013.01); *H04R 31/00* (2013.01); *H04R 2201/003* (2013.01)

(58) Field of Classification Search

CPC ..... H04R 1/08; H04R 19/005; H04R 31/00; H04R 2201/003

USPC ..... 257/416

See application file for complete search history.

(56) References Cited

U.S. PATENT DOCUMENTS

| | | | | |
|---|---|---|---|---|
| 2004/0196215 | A1* | 10/2004 | Duthaler | G02F 1/1362 345/30 |
| 2007/0189558 | A1* | 8/2007 | Ogura | B81B 7/0061 381/191 |
| 2008/0232615 | A1* | 9/2008 | Song | H04R 19/005 381/174 |
| 2011/0293126 | A1* | 12/2011 | Maekawa | H04R 19/005 381/355 |

FOREIGN PATENT DOCUMENTS

| | | | |
|---|---|---|---|
| EP | 1722596 | A1 | 11/2006 |
| EP | 2393306 | A2 | 7/2011 |
| EP | 2381698 | A1 | 10/2011 |

OTHER PUBLICATIONS

International Search Report corresponding to co-pending International Patent Application Serial No. PCT/EP2012/058031, European Patent Office, dated Feb. 4, 2013; (3 pages).

Japanese Examination Report corresponding to co-pending Japanese Patent Application, Japanese Patent Office, dated Nov. 4, 2015; (3 pages).

* cited by examiner

*Primary Examiner* — Fernando L Toledo
*Assistant Examiner* — Adam S Bowen
(74) *Attorney, Agent, or Firm* — Nixon Peabody LLP

(57) ABSTRACT

The present invention concerns a MEMS microphone assembly (1) comprising a MEMS transducer element (2) comprising a MEMS die (3), a back plate (4) and a diaphragm (5) displaceable in relation to the back plate (4), and a sound inlet (16) for acoustically coupling the MEMS transducer element (2) to the exterior of the MEMS microphone assembly (1), wherein the MEMS die (3) comprises an indentation (17) that forms at least a part of the sound inlet (16). Further, the present invention concerns a method of manufacturing said MEMS microphone assembly (1).

22 Claims, 3 Drawing Sheets

Figure 1:
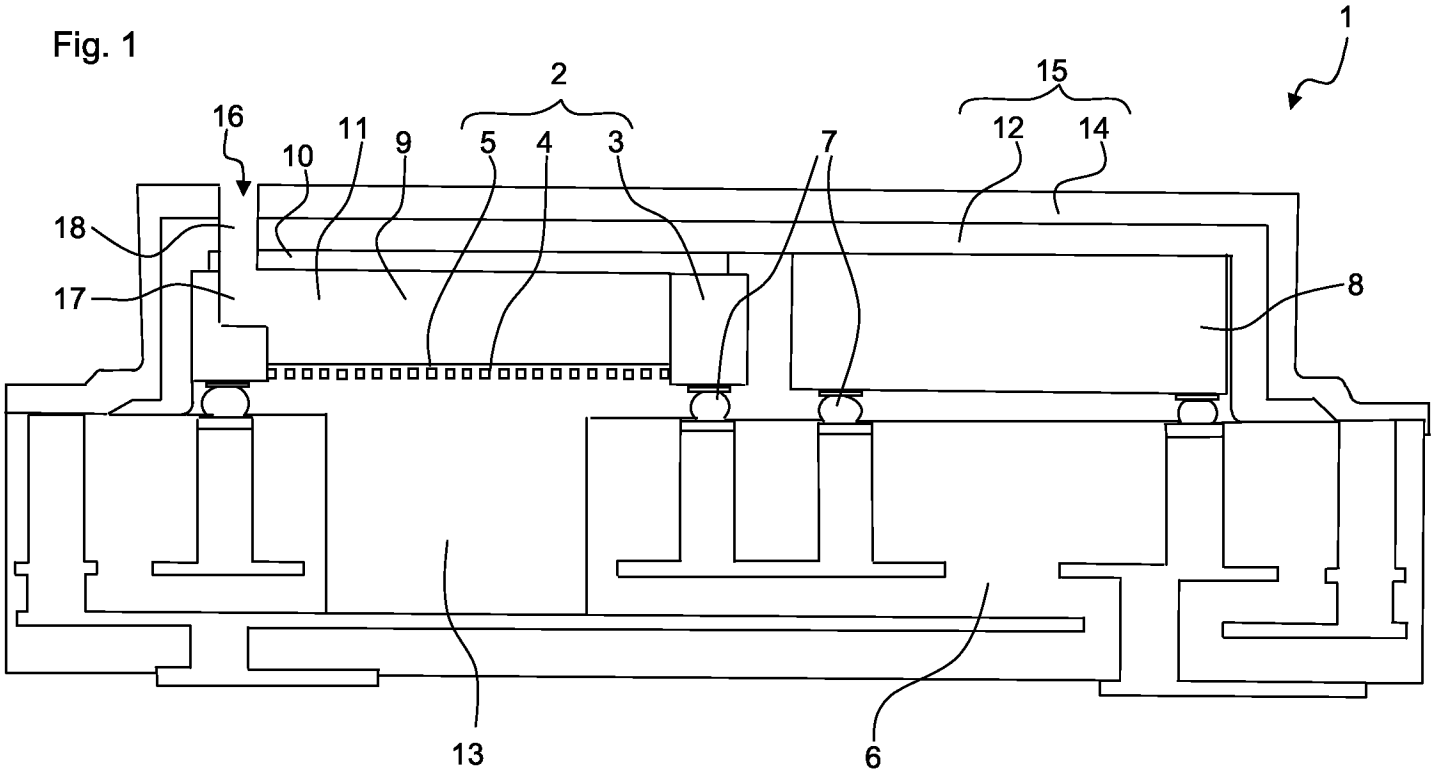

MEMS MICROPHONE ASSEMBLY AND METHOD OF MANUFACTURING THE MEMS MICROPHONE ASSEMBLY

CROSS-REFERENCE TO RELATED APPLICATIONS

This application is a U.S. National Stage of International Application No. PCT/EP2012/058031, filed May 2, 2012, all of which is incorporated herein by reference in its entirety.

The present invention concerns an MEMS microphone assembly and a method of manufacturing the MEMS microphone assembly.

A MEMS microphone assembly may comprise a MEMS transducer element comprising a back plate and a displaceable diaphragm. In order to allow for a long lifetime of the MEMS microphone assembly, it is important to provide electrical and mechanical protection of the transducer element. At the same time, the transducer element needs to be in acoustic contact with the exterior of the microphone. Preferably, long and narrow sound inlets and large front volumes need to be avoided as they deteriorate the quality of the acoustical performance, in particular result in a poor high audio frequency performance.

It is an object of the present invention to provide an MEMS microphone assembly and a method of manufacturing the MEMS microphone assembly wherein these contradicting objectives are solved, i.e. providing a good acoustic coupling and providing mechanical and electrical protection.

This object may be achieved by a MEMS microphone assembly according to present claim 1. Further, the object may be achieved by a method of manufacturing the MEMS microphone assembly according to the independent claim. Further features, advantageous embodiments and expediencies are subject-matter of the dependent claims.

According to one aspect, a MEMS microphone assembly comprises a MEMS transducer element comprising a MEMS die, a back plate and a diaphragm displaceable in relation to the back plate. The MEMS microphone assembly further comprises a sound inlet for acoustically coupling the transducer element to the exterior of the MEMS microphone assembly, wherein the MEMS die comprises an indentation that forms at least a part of the sound inlet.

In particular, the sound inlet may acoustically couple a cavity defined in the transducer element with the exterior of the MEMS microphone assembly.

The indentation may define a channel that is a part of the sound inlet.

In general, the sound inlet may comprise an opening extending through a sealing layer encapsulating the transducer element and the sound inlet may further comprise the indentation defining a channel in the MEMS die. The opening extending through a sealing layer may be a hole. Further, the opening may also extend through a cover covering the transducer element and defining a cavity between said cover and the diaphragm.

At least a part of the sound inlet is defined directly by the indentation in the MEMS die. Thereby, it is ensured that the length of the sound inlet is kept to a minimum as there is no need for additional elements defining the sound inlet and coupling it to the MEMS die. Further, defining at least a part of the sound inlet by the indentation of the MEMS die allows defining the opening extending through a sealing layer at a position radially spaced away from a cavity of the transducer element. Accordingly, the sound inlet does not interfere with the elements that are responsible for an electrical and a mechanical shielding. Since the sound inlet is defined at least in parts by the indentation, a large part of the microphone assembly can be utilized as back volume, thereby providing a good acoustic quality.

In a preferred embodiment, the MEMS microphone assembly comprises a cover over the MEMS die forming and enclosing the cavity between the diaphragm and the cover. The cover may be e.g. a foil. The cavity provides the front volume of the transducer element. The cavity is in acoustic contact with the sound inlet defined at least in a part by the indentation.

In one embodiment, the indentations are placed adjacent to the cavity. Thereby, it is ensured that the cavity is acoustically and mechanically shielded by the cover and at the same time is in acoustic contact to the exterior of the microphone assembly via the sound inlet. The sound inlet may define an angle such that the sound inlet provides no straight line from the exterior to the diaphragm.

In one embodiment, the indentation defined in the MEMS die opens out into the cavity. Accordingly, the cavity is acoustically coupled to the indentation and, thereby, to the exterior of the microphone assembly.

In one embodiment, the MEMS microphone assembly comprises a substrate wherein the transducer element is mounted on the substrate and the sound inlet is arranged on the side of the transducer element facing away from the substrate. In other words, the microphone assembly is a top-port microphone.

Usually top-port microphones require a large front volume, thereby deteriorating the quality of the acoustic performance. However, by defining at least a part of the sound inlet by the indentation of the MEMS die, the front volume of the top-port microphone is kept to a minimal volume. Thereby, a flat frequency response up to high audio frequencies is provided.

In one embodiment the transducer element is covered by a sealing layer and an opening extends through the sealing layer, the opening defining a part of the sound inlet. The sealing layer may also cover the cover which covers at least parts of the transducer element. In particular, the cover may define the cavity between the diaphragm and the cover.

The sealing layer may encapsulate the transducer element. The sealing layer may further encapsulate an ASIC together with the transducer element.

The sealing layer may comprise a foil and a metallization layer. In particular, a first grounding metallization layer may be applied on the foil and afterwards a resist structure may be placed at the spot where the opening will be created in a later step. In a next step, the grounding metallization may be galvanically enhanced and afterwards the resist structure may be removed.

The MEMS microphone may comprise multiple sound inlets. Providing more than one sound inlet may improve the acoustical performance of the microphone. Multiple sound inlets may also be arranged in a way to provide a directional selectivity or sensitivity of the microphone such that the sensitivity of the microphone assembly is increased in one direction compared to the sensitivity of the microphone assembly in another direction.

Each of the multiple sound inlets may provide an acoustic coupling of the exterior of the MEMS microphone assembly to the cavity defined between the cover and the diaphragm of the transducer element.

The MEMS die may comprise at least two indentations, each indentation defining at least a part of one of the sound inlets. Each indentation may define a channel. However, the invention is not restricted to a specific shape of the channels.

The top wall of a channel connecting the opening extending through the sealing layer and the cavity may be closed wherein the top wall is the upper wall of the channel arranged opposite to the substrate. The top wall of the channel may be covered by either the sealing layer or by parts of the MEMS die.

The transducer element may be covered by a sealing layer and multiple openings may extend through the sealing layer, where each opening is in acoustic contact with at least one indentation. An opening may also be in contact with more than one indentation.

In one embodiment, the indentation is tapered such that its width widens towards the diaphragm and the back plate. The smaller diameter at the end facing away from the diaphragm and the back plate ensures a good mechanical protection. The increasing width ensures a good acoustical coupling.

A second aspect of the present invention concerns a method of manufacturing the above-discussed MEMS microphone assembly.

The method comprises the steps of:

providing a substrate, mounting a MEMS transducer element comprising a MEMS die, a back plate and a diaphragm displaceable in relation to the back plate on the substrate, wherein the MEMS die comprises an indentation, covering the MEMS transducer element with a sealing layer, and forming an opening in the sealing layer that is in acoustic contact with the indentation of the MEMS die such that a sound inlet for acoustically coupling the transducer element to the exterior of the MEMS microphone assembly is formed.

Accordingly, the method provides a way to manufacture a MEMS microphone assembly with the above discussed advantages.

In one embodiment, the indentation of the MEMS die is formed on wafer-level. Accordingly, the indentation of the MEMS die is defined before the MEMS die is assembled on the substrate.

In one embodiment, the MEMS die comprises multiple indentations and multiple openings are formed in the sealing layer such that each opening is in acoustic contact with at least one indentation and each indentation forms at least a part of a sound inlet for acoustically coupling the MEMS transducer element to the exterior of the MEMS microphone assembly. In particular, multiple sound inlets improve the quality of the acoustical performance of the microphone assembly. Further, multiple sound inlets may enable the construction of a microphone assembly having a higher acoustic sensitivity in one direction than in another direction.

The opening in the sealing layer may be formed by laser cutting. The indentations may be formed by laser cutting or etching.

Further features, refinements and expediencies become apparent from the following description of the exemplary embodiments in connection with the figures.

FIG. 1 schematically shows a cross-sectional view of a top-port MEMS microphone assembly.

Figure 2:
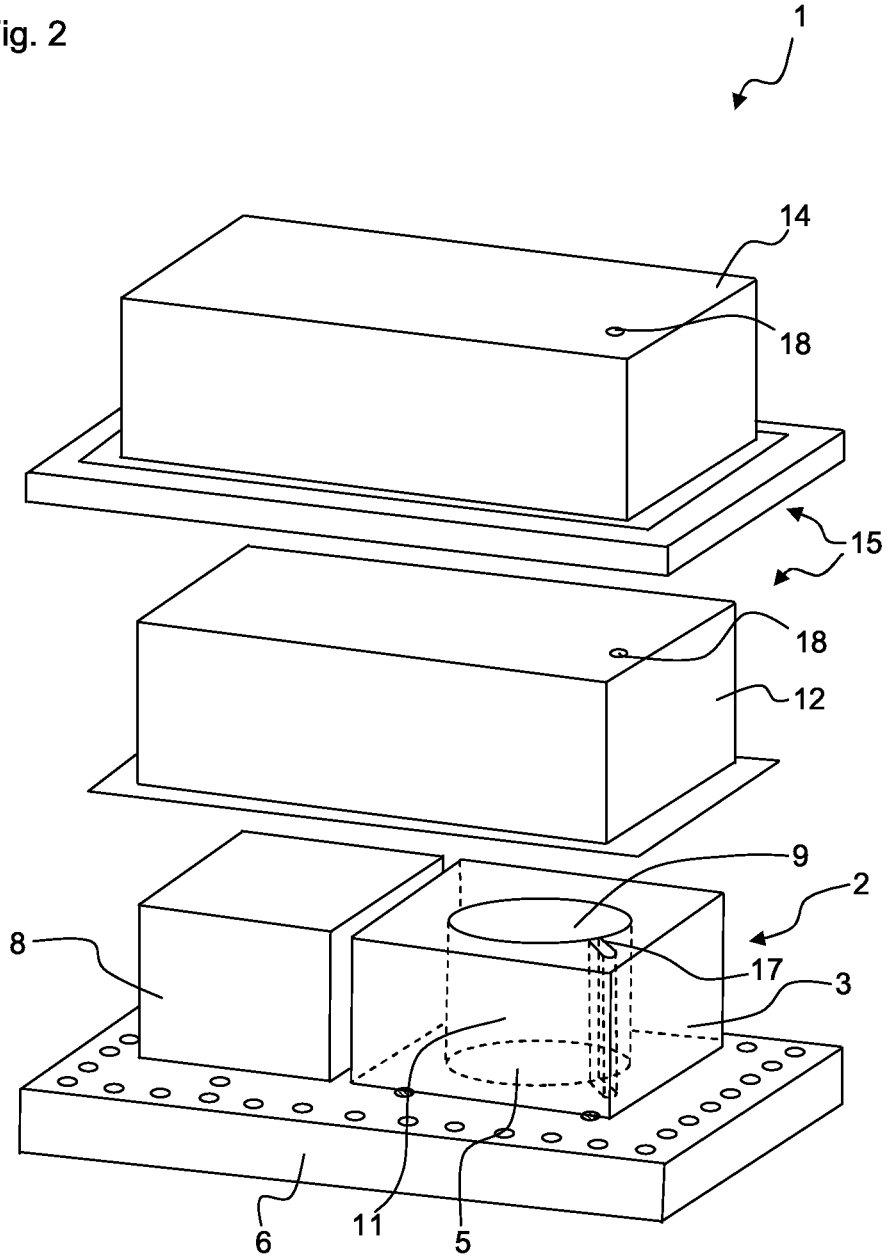

FIG. 2 schematically shows an exploded view of parts of the top-port MEMS microphone of FIG. 1.

Figure 3:
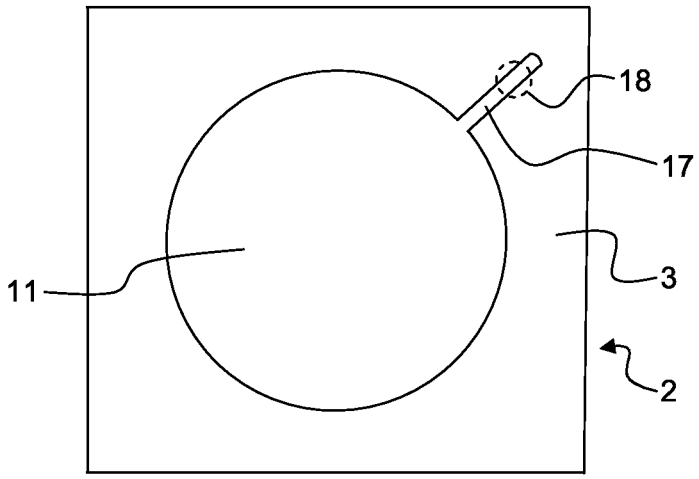

FIG. 3 schematically shows a plane view of the MEMS microphone assembly.

Figure 4:
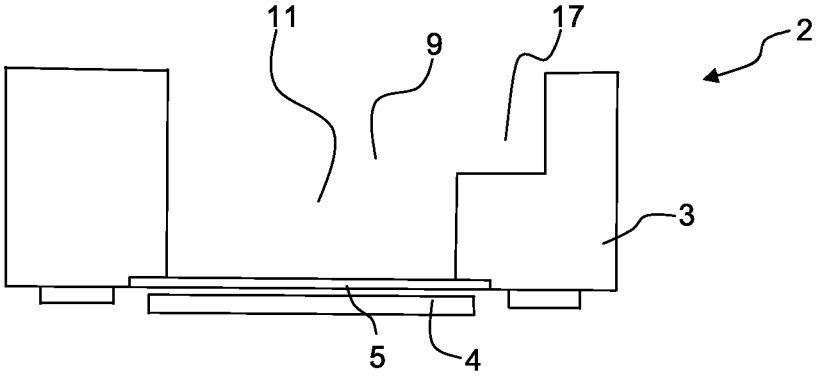

FIG. 4 schematically shows a cross-sectional view of the transducer element of FIG. 3.

Figure 5:
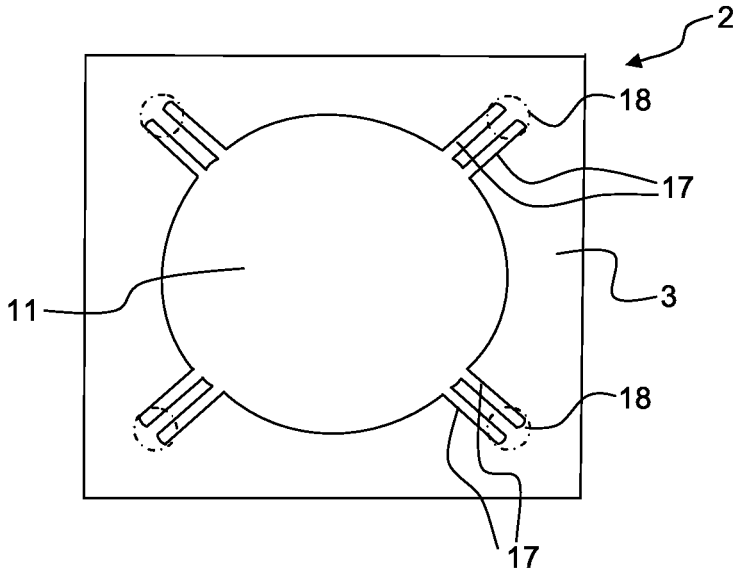

FIG. 5 schematically shows a plane view of a microphone assembly according to a second embodiment.

FIG. 1 schematically shows a cross-sectional view of a top-port MEMS microphone assembly 1. The MEMS microphone assembly 1 comprises an MEMS transducer element 2. The transducer element 2 is enabled to transform acoustical signals into electrical signals.

The transducer element 2 comprises an MEMS die 3, a back plate 4 and a displaceable diaphragm 5 wherein the diaphragm 5 is displaceable with respect to the back plate 4. A bias voltage may be applied between the diaphragm 5 and the back plate 4 and an acoustical signal displaces the diaphragm 5 with respect to the back plate 4 thereby amending the capacitance between the diaphragm 5 and the back plate 4.

The transducer element 2 is arranged on a substrate 6, e.g. by bumps 7 formed above electrical contacts of the substrate 6. Further, an ASIC 8 is also arranged on the substrate 6 adjacent to the transducer element 2. The ASIC 8 is also mechanically fixed and electrically contacted to the substrate 6 by bumps 7.

The MEMS die 3 has a recess 9 on its side facing away from the substrate 6. The recess 9 of the MEMS die 3 is covered by a first foil 10. Accordingly, the first foil 10 forms a cover of the transducer element 2. The recess 9 defines a first cavity 11 between the diaphragm 5 and the first foil 10. The first cavity 11 is the so-called front volume of the transducer element 2.

Further, a second foil 12 covers the transducer element 2 and the ASIC 8. The second foil 12 encapsulates the transducer 2 element and the ASIC 8. Thereby, a second cavity 13 is defined between the back plate 4 of the transducer element 2 and the substrate 6. The second cavity 13 is also referred to as the back volume of the transducer element 2.

Further, a metallization layer 14 is arranged above the second foil 12. The metallizaton layer 14 and the second foil 12 thereby define a sealing layer 15. The metallization layer 14 may comprise a grounding metallization that is further galvanically enhanced. The metallization layer 14 provides an electromechanical shielding of the transducer element 2.

Moreover, the MEMS microphone assembly 1 comprises a sound inlet 16 which acoustically couples the first cavity 11, i.e. the front volume, to the exterior of the microphone assembly 1. The sound inlet 16 comprises an opening 18 extending through the sealing layer 15 and the first foil 10.

Further, an indentation 17 is defined in the MEMS die 3. The indentation 17 is arranged adjacent to the first cavity 11 arranged between the first foil 10 and the diaphragm 5 of the transducer element 2. The indentation 17 defines a part of the sound inlet 16.

Accordingly, the sound inlet 16 comprises the opening 18 extending through the sealing layer 15 and the first foil 10 covering the transducer element 2. The sound inlet 16 further comprises the indentation 17 defined in the MEMS die 3. The sound inlet 16 is arranged adjacent to the first cavity 11. Accordingly, the first cavity 11 is protected against electrical and mechanical disturbances from the exterior by the first foil 10 and the sealing layer 15 covering the first cavity 11.

Furthermore, the opening 18 and the indentation 17 defined by the MEMS die 3 define the sound inlet 16 such that the sound inlet 16 is short and allows a very good acoustical coupling of the transducer element 2 to the exterior of the microphone assembly 1. The arrangement of the sound inlet 16 allows to minimize the front volume, i.e. the first cavity 11, and, thereby, given a complete volume of the MEMS microphone assembly 1, to maximize the back volume.

Thus, the acoustical performance of the microphone assembly 1 is optimized. In general, in order to maximize the acoustical performance, the front volume needs to be minimized and the back volume needs to be maximized. In the present embodiment, the sound inlet 16 having a minimized length provides a flat frequency response of the transducer element 2.

The sound inlet 16 shown in FIG. 1 has a L-shaped cross-section. However, the indentation 17 may have a different shape such that the cross-section of the sound inlet 16 is altered. For example, the indentation 17 may comprise a curved sidewall. In this case, the cross-section of the sound-inlet may be S-shaped.

Further, FIG. 2 schematically shows the top-port MEMS microphone assembly 1 shown in FIG. 1 in an exploded view. However, it should be noted that FIG. 2 does not indicate a way to assemble the parts of the MEMS microphone assembly 1. FIG. 2 rather provides a schematical perspective view of some of the parts of the MEMS microphone assembly. In particular, FIG. 2 shows each of the metallization layer 14, the second foil 12 and the transducer element 2 and the ASIC 8 arranged on the substrate 6 as a separate element.

It can be seen in FIG. 2 that the sound inlet 16 is defined by the opening 18 extending through the metallization layer 14 and the second foil 12 and is further defined by the indentation 17 defined in the MEMS die 3. The opening 18 further extends through the first foil 10 which is not shown in FIG. 2 as it is buried by the second foil 12 in this perspective.

FIG. 3 shows the MEMS transducer element 2 in a plane view. It can be gathered from FIG. 3 that the diaphragm 5 and the back plate 4 have a circular shape. The indentation 17 shown in FIG. 3 is defining a channel adjacent to the diaphragm 5. The channel opens out into the first cavity 11 defined between the diaphragm 5 and the first foil 10.

In the embodiment shown in FIG. 3, the channel has a constant width. However, alternate shapes of the indentation 17 are possible as well. For example, the indentation 17 may be tapered such that the width of the channel increases towards the first cavity 11. Moreover, the opening 18 in the sealing layer 15 is arranged above the indentation 17 in a direction pointing away from the substrate 6. The opening 18 in the sealing layer 15 is circular. The opening 18 in the sealing layer 15 has a diameter that is larger than the width of the channel defined by the indentation 17.

FIG. 4 shows a cross-sectional view of the MEMS transducer element 2. It is again shown in FIG. 4 that the indentation 17 of the MEMS die 3 defines a part of the sound inlet 16 opening out into the first cavity 11. The indentation 17 is arranged adjacent to the first cavity 11.

Further, the indentation defines a rectangular angle such that the sound inlet provides no straight line from the exterior to the diaphragm 5. Thereby, a mechanical protection of the first cavity 11 and the diaphragm 5 is ensured.

However, the indentation may also have a different shape. In particular, the indentation may be defined by two sidewalls defining an acute angle or defining an obtuse angle. The indentation may also be defined by a single sidewalls that comprises a rounded part thereby having a shape of a segment of an ellipse.

FIG. 5 shows a plane view of the transducer element 2 according to a second embodiment. The second embodiment of the microphone assembly 1 differs from the first embodiment in that the second embodiment comprises more than one sound inlet 16. Therefore, the second embodiment comprises multiple indentations 17 defined in the MEMS die 3. Further, multiple openings 18 extend through the sealing layer 15. In this embodiment, each opening 18 defined in the sealing layer 15 is in acoustic contact with two indentations 17 defined in the MEMS die 3. Each indentation 17 is formed as a channel opening out into the first cavity 11. Each of the channels has a constant width.

Alternatively, each opening 18 in the sealing layer 15 may be in acoustic contact with exactly one indentation 17 defined in the MEMS die 3.

Moreover, the present invention concerns a method of manufacturing the MEMS microphone assembly 1. This method comprises the steps of providing the substrate 6, mounting the MEMS transducer element 2 comprising the MEMS die 3, the back plate 4 and the diaphragm 5 displaceable in relation to the back plate 4 on the substrate 6 wherein the indentation 17 is defined in the MEMS die 3. The indentation 17 defined in the die 3 is formed on wafer-level, i.e. before the MEMS die 3 is mounted on the substrate 6.

The transducer element 2 is then covered with a first foil 10 defining a first cavity 11 between the diaphragm 5 and the first foil 10.

Further, in a next step, the transducer element 2 is covered with a sealing layer 15 and the opening 18 is formed in the sealing layer 15 and may be in the first foil 10 as well such that the opening 18 is in acoustic contact with the indentation 17. Thereby, the sound inlet 16 for acoustically coupling the transducer element 2 to the exterior of the MEMS microphone assembly 1 is defined. The opening 18 in the sealing layer 15 may be formed, e.g. by laser cutting.

The sealing layer 15 is formed by arranging the second foil 12 over the transducer element 2 encapsulating the transducer element 2. In a next step, a grounding metallization is sputtered on the second foil 12. The grounding metallization may further be galvanically enhanced to form the metallization layer 14. A resist structure may be used to prevent the galvanic enhancement of the grounding metallization in the area where the opening 18 is arranged in a later manufacturing step.

REFERENCE NUMERALS

1—MEMS microphone assembly
2—MEMS transducer element
3—MEMS die
4—back plate
5—diaphragm
6—substrate
7—bumps
8—ASIC
9—recess
10—first foil
11—first cavity
12—second foil
13—second cavity
14—metallization layer
15—sealing layer
16—sound inlet
17—indentation
18—opening

The invention claimed is:

1. MEMS microphone assembly, comprising a MEMS transducer element comprising a MEMS die, a back plate and a diaphragm displaceable in relation to the back plate, and a sound inlet for acoustically coupling the MEMS transducer element to the exterior of the MEMS microphone assembly, wherein the MEMS die comprises an indentation that forms at least a part of the sound inlet.

2. MEMS microphone assembly according to claim 1, further comprising a cover defining a cavity between the diaphragm and the cover.

3. MEMS microphone assembly according to claim 2, wherein the indentation is placed adjacent to the cavity.

4. MEMS microphone assembly according to claim 3, wherein the indentation opens out into the cavity.

5. MEMS microphone assembly according to claim 3, wherein the indentation is tapered such that its width increases towards the cavity.

6. MEMS microphone assembly according to claim 2, wherein the indentation is tapered such that its width increases towards the cavity.

7. MEMS microphone assembly according to claim 2, further comprising a substrate, wherein the MEMS transducer element is mounted on the substrate and the sound inlet is arranged on a side of the MEMS transducer element facing away from the substrate.

8. MEMS microphone assembly according to claim 2, wherein the MEMS transducer element is covered by a sealing layer and an opening extends through the sealing layer, the opening defining a part of the sound inlet.

9. MEMS microphone assembly according to claim 2, comprising multiple sound inlets.

10. MEMS microphone assembly according to claim 1, further comprising a substrate, wherein the MEMS transducer element is mounted on the substrate and the sound inlet is arranged on a side of the MEMS transducer element facing away from the substrate.

11. MEMS microphone assembly according to claim 1, wherein the MEMS transducer element is covered by a sealing layer and an opening extends through the sealing layer, the opening defining a part of the sound inlet.

12. MEMS microphone assembly according to claim 1, comprising multiple sound inlets.

13. MEMS microphone assembly according claim 12, wherein the MEMS die comprises at least two indentations, each indentation defining at least a part of one of the sound inlets.

14. MEMS microphone assembly according to claim 13, wherein the MEMS transducer element is covered by a sealing layer and multiple openings extend through the sealing layer, each opening being in acoustic contact with at least one indentation.

15. MEMS microphone assembly according to claim 1, wherein the indentation is configured to lead sound signals sideways into a cavity that forms a front volume of the transducer element.

16. MEMS microphone assembly according to claim 1, wherein the indentation is defined in the MEMS die.

17. Method of manufacturing a MEMS microphone assembly, comprising the steps of:

providing a substrate, mounting a MEMS transducer element comprising a MEMS die, a back plate and a diaphragm displaceable in relation to the back plate on the substrate, wherein the MEMS die comprises an indentation, covering the MEMS transducer element with a sealing layer, and forming an opening in the sealing layer that is in acoustic contact with the indentation of the MEMS die such that a sound inlet for acoustically coupling the transducer element to the exterior of the MEMS microphone assembly is formed.

18. Method according to claim 17, wherein the indentation of the MEMS die is formed on wafer-level.

19. Method according to claim 18, wherein the MEMS die comprises multiple indentations and multiple openings are formed in the sealing layer such that each opening is in acoustic contact with at least one indentation and each indentation forms at least a part of a sound inlet for acoustically coupling the MEMS transducer element to the exterior of the MEMS microphone assembly.

20. Method according to claim 18, wherein the opening is formed by laser cutting.

21. Method according to claim 17, wherein the MEMS die comprises multiple indentations and multiple openings are formed in the sealing layer such that each opening is in acoustic contact with at least one indentation and each indentation forms at least a part of a sound inlet for acoustically coupling the MEMS transducer element to the exterior of the MEMS microphone assembly.

22. Method according to claim 17, wherein the opening is formed by laser cutting.

* * * * *